US008162517B2

(12) United States Patent
Lee

(10) Patent No.: US 8,162,517 B2
(45) Date of Patent: Apr. 24, 2012

(54) LAMP

(75) Inventor: Steve Lee, Park Ridge, IL (US)

(73) Assignee: LumiSource, Inc., Elk Grove Village, IL (US)

( * ) Notice: Subject to any disclaimer, the term of this patent is extended or adjusted under 35 U.S.C. 154(b) by 208 days.

(21) Appl. No.: 12/403,617

(22) Filed: Mar. 13, 2009

(65) Prior Publication Data

US 2009/0237921 A1 Sep. 24, 2009

Related U.S. Application Data

(60) Provisional application No. 61/036,339, filed on Mar. 13, 2008.

(51) Int. Cl.
*F21L 4/04* (2006.01)
*F21V 21/30* (2006.01)

(52) U.S. Cl. ... 362/418; 362/198; 362/231; 362/249.05; 362/388

(58) Field of Classification Search ..... 362/189, 362/198, 205, 231, 249.05, 388, 418
See application file for complete search history.

(56) References Cited

U.S. PATENT DOCUMENTS

| | | | | |
|---|---|---|---|---|
| 3,960,376 | A * | 6/1976 | Berlin | 273/449 |
| 4,768,138 | A * | 8/1988 | Leopoldi et al. | 362/189 |
| 5,385,500 | A * | 1/1995 | Schmidt | 446/73 |
| 6,042,245 | A * | 3/2000 | Stanley | 362/191 |
| 6,641,283 | B1 * | 11/2003 | Bohler | 362/238 |
| 6,814,465 | B2 * | 11/2004 | Forsythe | 362/205 |
| 6,848,815 | B1 * | 2/2005 | Born | 362/477 |
| 7,172,313 | B2 * | 2/2007 | Abel et al. | 362/205 |
| 7,172,486 | B2 * | 2/2007 | Drosendahl et al. | 446/81 |
| 7,484,867 | B2 * | 2/2009 | Farmer | 362/410 |
| 7,815,337 | B2 * | 10/2010 | Grossman | 362/189 |
| 2004/0090795 | A1 * | 5/2004 | Kim | 362/555 |
| 2009/0225542 | A1 * | 9/2009 | Belliveau et al. | 362/231 |

* cited by examiner

*Primary Examiner* — Peggy A. Neils
(74) *Attorney, Agent, or Firm* — Pauley Petersen & Erickson

(57) ABSTRACT

A lamp including a base, a bendable neck and a lamp head, an outer surface of the lamp covered by a pliable sheath. The lamp further including a plurality of switches and a plurality of light sources, such as light-emitting diodes (LEDs). The plurality of switches are visually concealed by the pliable sheath. A first actuation of at least one switch of the plurality of switches activates a white light mode of operation and a second actuation of at least one switch of the plurality of switches activates a color-phasing mode of operation.

21 Claims, 7 Drawing Sheets

LAMP

CROSS REFERENCE TO RELATED APPLICATION

This application claims the benefit of U.S. Provisional Application No. 61/036,339 filed on 13 Mar. 2008, and which is incorporated by reference herein and is made a part hereof, including but not limited to those portions which specifically appear in this patent application.

BACKGROUND OF THE INVENTION

1. Field of the Invention

This invention relates to a lamp, specifically a lamp covered in a pliable sheath and having a bendable neck and a plurality of switches positioned around a perimeter of a lamp head and visually concealed by the pliable sheath.

2. Description of Related Art

Many conventional lamps are equipped with a single switch for switching the lamp on and/or off. Often times, this single switch is difficult to locate and is visually unappealing. The surfaces of many conventional lamps are made of unpleasing to the touch materials, and have rough angles and/or edges that can be potentially dangerous to the user, especially if the user is a child.

SUMMARY OF THE INVENTION

According to a preferred embodiment of this invention, a lamp of this invention includes a base, a bendable neck having a first end connected to the base and a second end opposite the first end, and a lamp head attached to the second end of the bendable neck.

The lamp of this invention further includes one or more light sources mountable with respect to the lamp head and preferably positioned in a cavity defined by the lamp head. Light sources are operatively connectable to a power source.

The lamp of this invention is preferably powered by an internal DC power source, such as, for example, batteries, or, alternatively, an external AC power source. The internal power source is preferably enclosed within a chamber defined by the base.

According to one embodiment of this invention, the lamp further includes a USB port positioned within the base and connectable to an external power source or an external control device, such as a computer.

The lamp of this invention further includes a plurality of switches, which, when actuated, activate and/or deactivate one or more light sources. The plurality of switches are preferably positioned in a plurality of locations on a surface of the lamp head. The plurality of switches may be spaced around the perimeter of the lamp head. According to a preferred embodiment of this invention, each of the plurality of switches is individually actuatable to activate and/or deactivate one or more light sources.

The lamp of this invention further includes a pliable sheath, visually concealing the plurality of switches and preferably predominantly covering the entire lamp, specifically the base, the bendable neck and the lamp head. The pliable sheath may be permanently attached or removably attachable to the outer surface of the lamp. The pliable sheath may be made of, or incorporate, any natural and/or synthetic fibers known to those skilled in the art.

In one embodiment of this invention one or more of the light sources are light-emitting diodes (LEDs), at least one of which is selected from the group consisting of a white light-producing LED, a red light-producing LED, a blue light-producing LED, a green light-producing LED, and combinations thereof. In a preferred embodiment of this invention, the lamp includes a plurality of white-light producing LEDs and a plurality of colored light-producing LEDs. The plurality of colored-light producing LEDs includes at least one red light-producing LED, at least one blue light-producing LED and at least one green light-producing LED.

The lamp of this invention is preferably operable by a multi-step activation process. A first actuation of one of the plurality of switches may activate the plurality of white light-producing LEDs to an on-position. A second actuation of one of the plurality of switches may deactivate the white light-producing LEDs to an off-position and may further activate at least one of the plurality of colored light-producing LEDs to an on-position. A third actuation of one of the plurality of switches may deactivate the plurality of colored light-producing LEDs to an off position. The first actuation, the second actuation and the third actuation may be actuations of the same switch or different switches.

In one embodiment of this invention, the first actuation of one of the switches activates a white light mode of operation and a second actuation of one of the switches activates a color-phasing mode of operation.

Other advantages of this invention will be apparent to those skilled in the art, in view of the following detailed description taken in conjunction with the appended claims and drawings.

BRIEF DESCRIPTION OF THE DRAWINGS

The drawings show a lamp, according to preferred embodiments of this invention, wherein.

Figure 1:
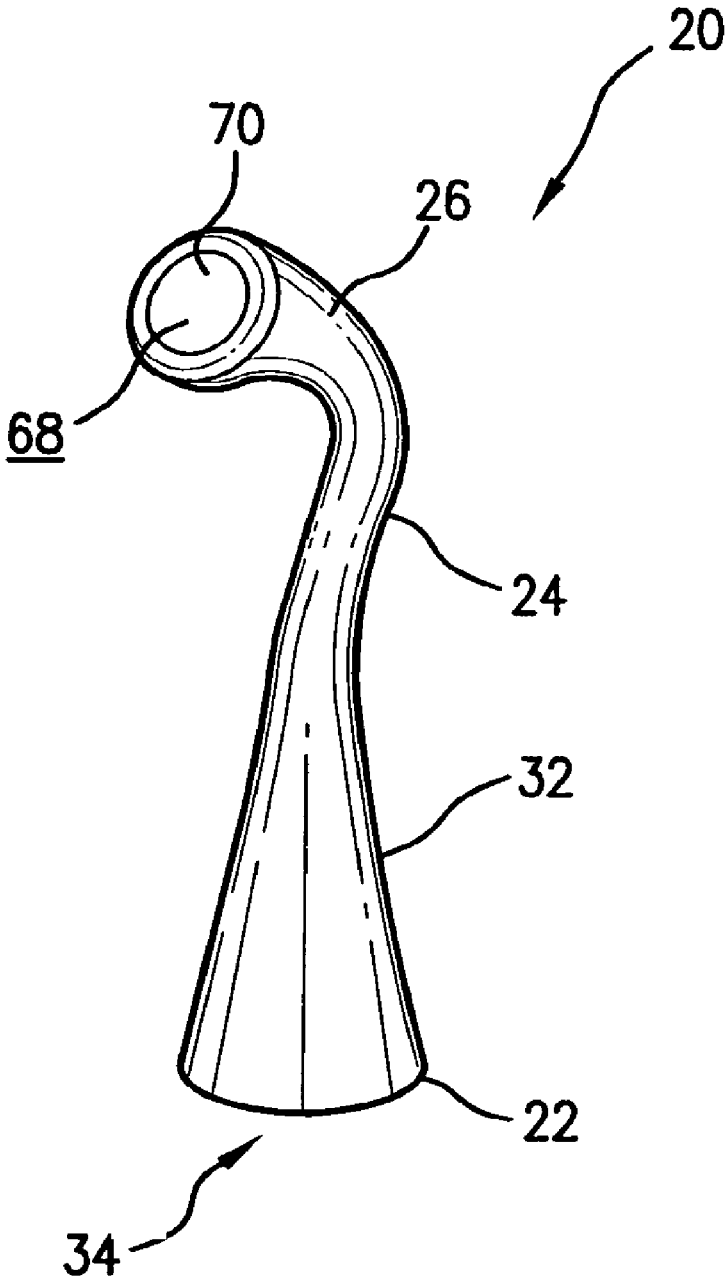
FIG. 1 is a front left perspective view of a lamp according to one embodiment of this invention.
Figure 2:
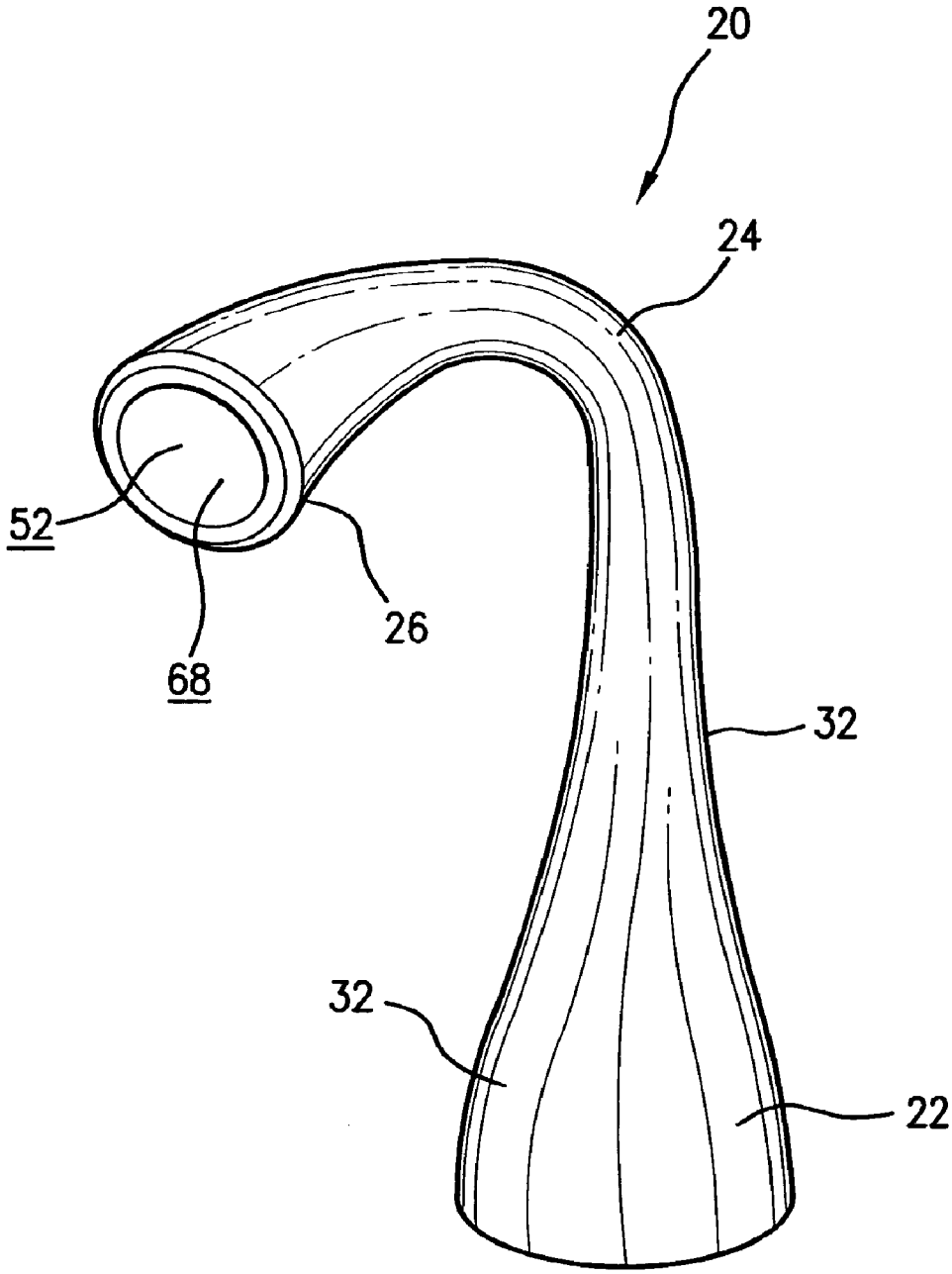
FIG. 2 is a front left perspective view of a lamp according to one embodiment of this invention.

It should be understood that the drawings are of preferred embodiments, and that there may be other embodiments of this invention. Therefore, it should be understood that the drawings are not intended to limit the scope of this invention, but that the scope of this invention be defined by the claims that follow the description of preferred embodiments.

DESCRIPTION OF PREFERRED EMBODIMENTS

FIGS. 1-16 show lamp 20 according to various preferred embodiments of this invention.

With reference to FIGS. 1-16, lamp 20 of this invention preferably includes base 22, bendable neck 24 and lamp head 26. Lamp 20 further includes one or more light sources 28 and a plurality of switches 30 for activating and/or deactivating light sources 28. Lamp 20 further includes pliable sheath 32, concealing switches 30 and almost entirely covering lamp 20.

Figure 4:
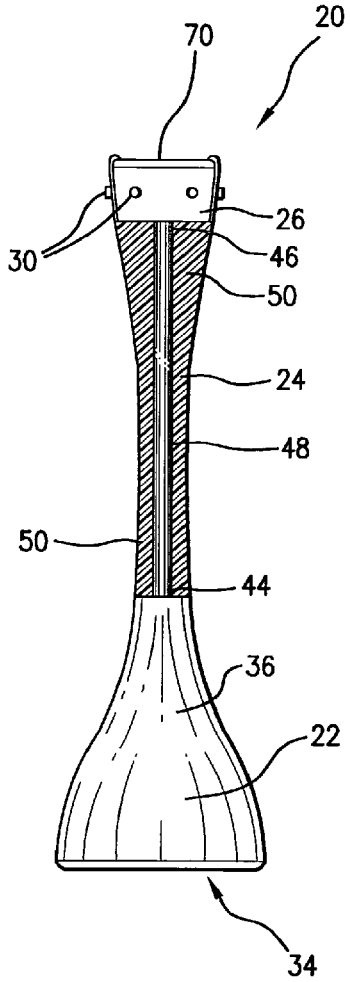
FIG. 4 is a front, partially cross-sectional, view of a lamp according to one embodiment of this invention, without the pliable sheath.

According to one embodiment of this invention, as shown in FIG. 4, base 22 comprises generally flat support surface 34 and body surface 36 defining the shape of base 22. Base 22 may have any desired shape sufficient to maintain lamp 20 in a preferred upright position. In one embodiment of this invention, shown in FIG. 4, base 22 resembles a cylinder, narrowing in the direction away from support surface 34. Support surface 34 is preferably generally flat to facilitate positioning of lamp 20 on a flat surface formed by a furniture piece, such as, for example, a table or a chair, a floor or other object. Base 22 is preferably made of a rigid material, such as, for example, plastic, metal, wood or other similar natural or synthetic material and combinations thereof. According to an alternative embodiment of this invention (not shown), base 22 comprises a releasable attachment mechanism, for fastening, mounting, or otherwise releasably attaching base 22 to another object. For example, base 22 may comprise a clamp for clamping lamp 20 to a furniture piece.

Figure 9:
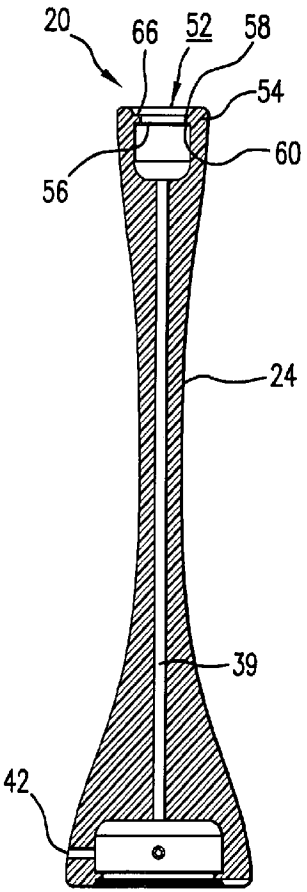
FIG. 9 is a cross-sectional view of the lamp shown in FIG. 8, rotated 90 degrees from the view shown in FIG. 8.

Means of powering lamp 20 of this invention may be provided by an internal DC power source (not shown), such as one or more batteries, or an external AC power source (not shown). The internal power source is preferably enclosed within base 22. According to one preferred embodiment of this invention, shown in FIGS. 15 and 16, base 22 defines chamber 38 therein for accommodating one or more internal power sources, such as, for example, batteries. Chamber 38 is accessible through removably attachable and/or openable access panel 40 positioned in support surface 34. As shown in FIG. 9, means 39 for transmitting electrical and/or electronic signal, such as, for example, electrical/electronic wiring, preferably operatively connect the internal power source and/or USB port 42 and one or more light sources 28.

Figure 8:
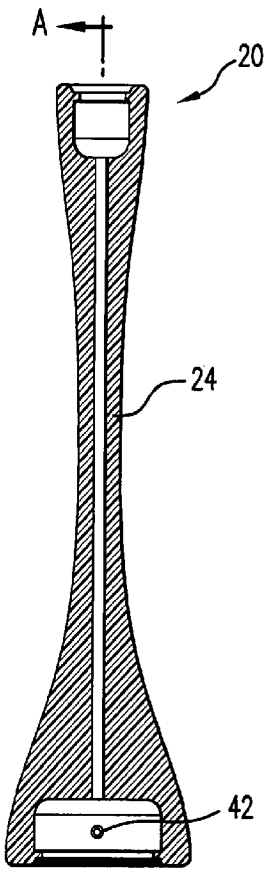
FIG. 8 is a cross-sectional view of the lamp, as shown in FIG. 7.
Figure 7:
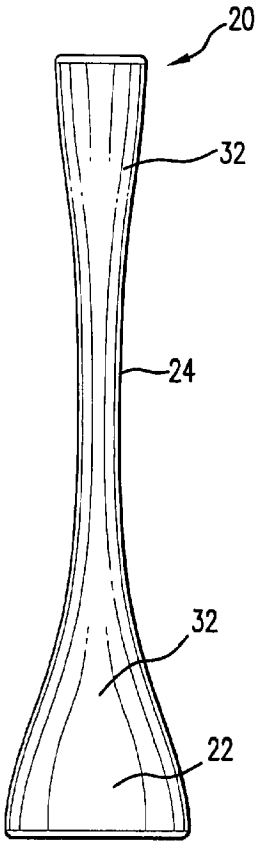
FIG. 7 is a front view of a lamp according to one embodiment of this invention.

As shown in FIGS. 8 and 9, lamp 20 may further include USB port 42 positioned within base 22. USB port 42 provides means for operably connecting lamp 20 with an external power source (not shown) or an external control device (not shown). Lamp 20 may receive an electrical and/or an electronic signal from the external power source and/or the external control device through USB port 42 and respond accordingly to the signal. Means 39 for transmitting electronic and/or electric signal, such as, for example, electronic/electrical wiring or wireless communication means, preferably operatively connect USB port 42 and one or more light sources 28. In one embodiment of this invention, lamp 20 receives a signal from an external control device, such as, for example, a personal computer, and responds to the signal by producing the desired lighting effect. The operation of lamp 20 may be controlled through the USB interface by an external control device, such as, for example, a computer, a personal player device, or a personal handheld device. For example, one or more light sources 28 of lamp 20 may by turned on and/or off by a signal or signals received from the external control device. The operation of one or more light sources 28 may be controlled to produce a desired lighting effect. For example, in response to a signal or signals received from the external control device, one or more of the plurality of light sources 28 are randomly and/or sequentially turned on and/or off, or the intensity of light produced by one or more of the light sources is continuously or interruptingly increased or decreased, to produce a desired lighting effect or sequence. The lighting effect, such as, for example, the intensity, the color of the light, the frequency and/or the sequence of color changes of light, produced by lamp 20 may, for example, be synchronized with picture, audio and/or other signals received from or produced by the external control device, for example, a song played through the speakers of a personal player device and/or a movie or picture show displayed on a computer screen.

Figure 3:
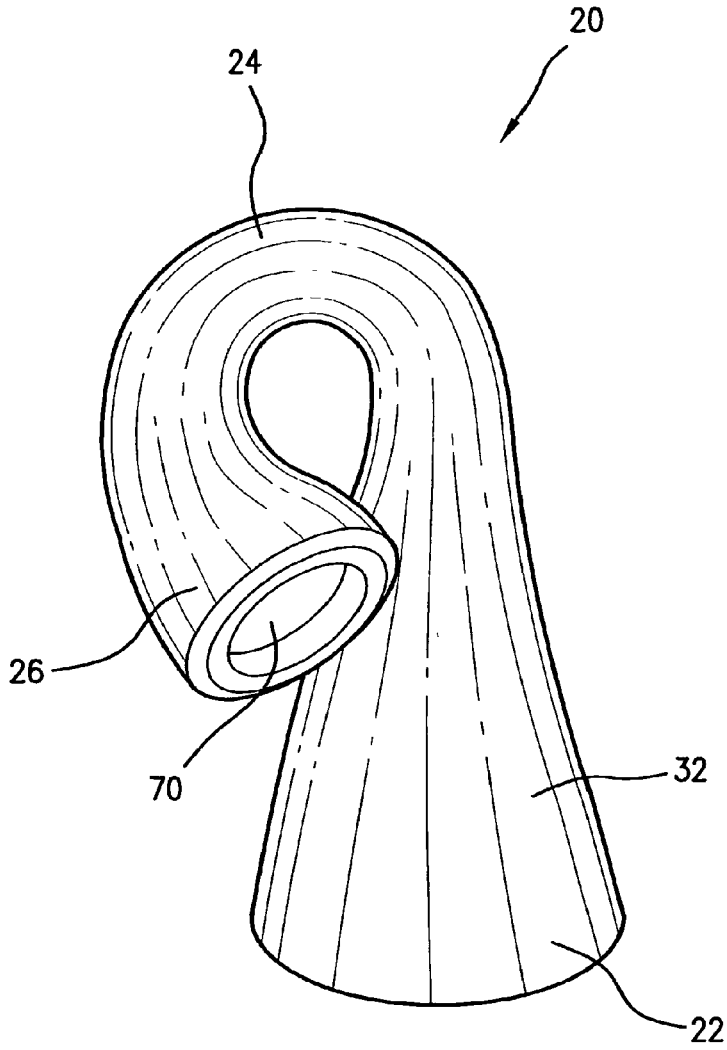
FIG. 3 is a front left perspective view of a lamp according to one embodiment of this invention.
Figure 5:
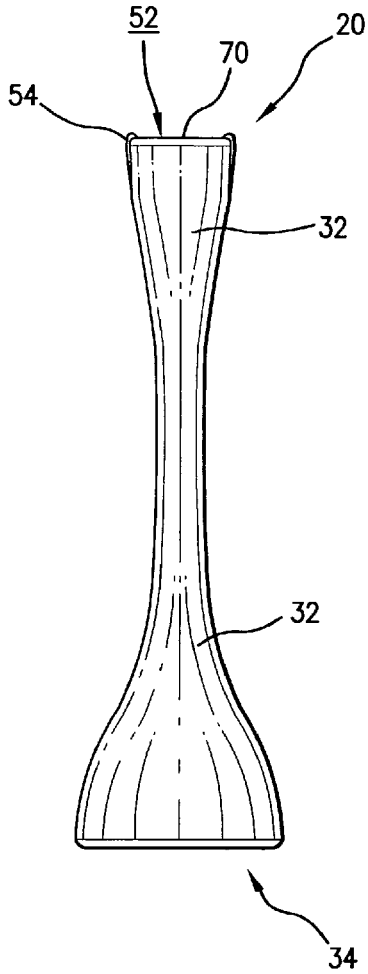
FIG. 5 is a front view of the lamp, as shown in FIG. 4, with the pliable sheath.
Figure 6:
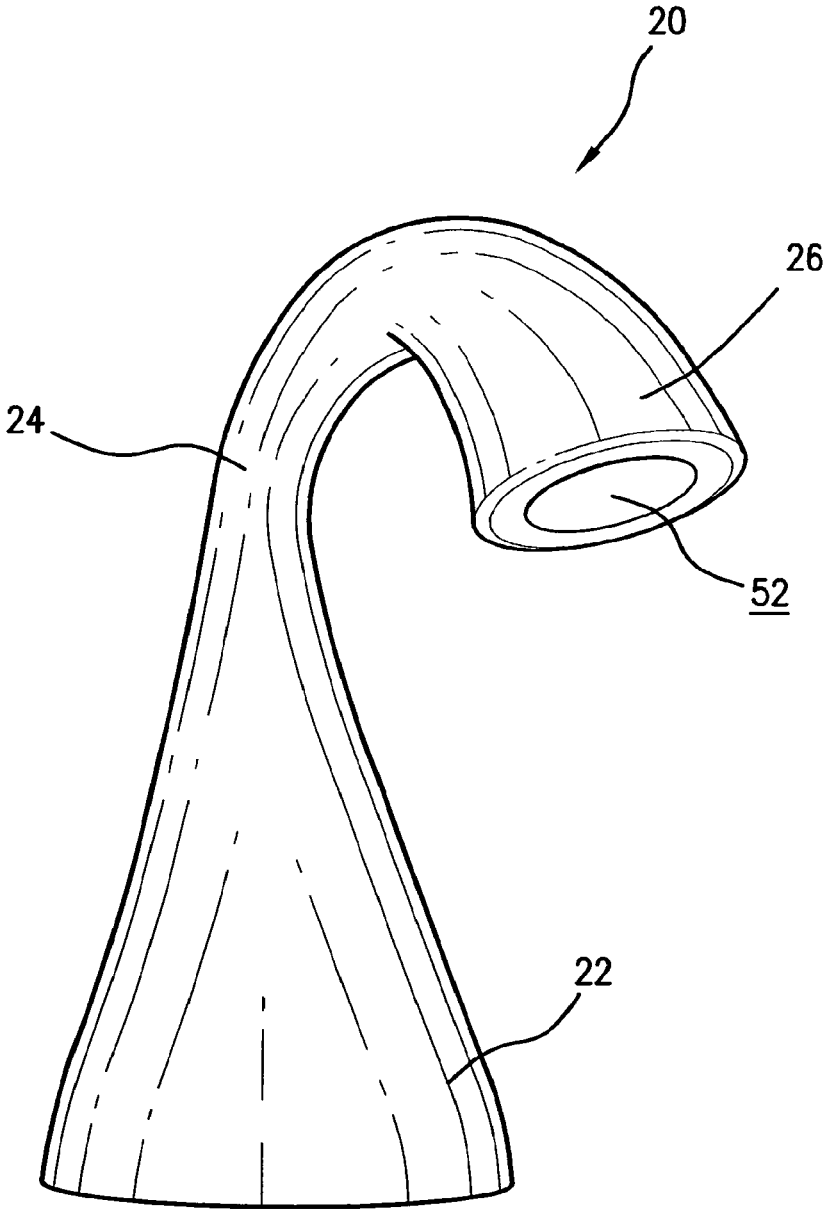
FIG. 6 is a front right perspective view of a lamp according to one embodiment of this invention.

As generally shown in FIG. 4, lamp 20 of this invention further includes bendable neck 24. Bendable neck 24 may be made of the same or different material as base 22. Bendable neck 24 preferably includes first end 44 connected to base 22 and second end 46 opposite first end 44. Second end 46 is connected to lamp head 26. Bendable neck 24 may be made of any material known to those skilled in the art such that the position of lamp head 26 may be adjusted with respect to base 22 and bendable neck 24 preferably maintains the adjusted position for a period of time and/or until the position of bendable neck 24 is re-adjusted again. For example, bendable neck 24 may be adjusted to direct the light produced by lamp 20 upwards, as shown in FIG. 5, sideways, as shown in FIG. 1, or downwards, as shown in FIG. 3. Bendable neck 24 is preferably adjustable and re-adjustable to any desired position. In one preferred embodiment, as shown in FIG. 4, outer surface 48 of bendable neck 24 is covered by padding 50. Padding 50 is preferably made of soft material such as, for example, foam, wool or similar natural or synthetic material. Padding 50 may be positioned along a portion or the entire length of bendable neck 24. Padding 50 may also cover or overlap surfaces of base 22 and/or lamp head 26.

Figure 11:
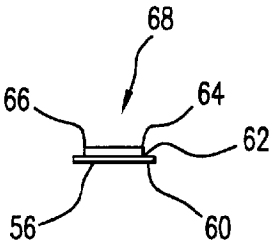
FIG. 11 is a partial side view of the lamp head, as shown in FIG. 10.
Figure 10:
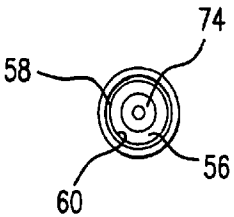
FIG. 10 is a top view of a lamp head, as shown in FIG. 9.

With reference to FIGS. 4, 5, and 8-14, lamp 20 further includes lamp head 26. Lamp head 26 is connected to second end 46 of bendable neck 24. At least one, and preferably a plurality of light sources 28, are mountable with respect to lamp head 26 and operatively connectable to a power source and/or USB port 42. According to one preferred embodiment of this invention, lamp head 26 defines cavity 52 therein, preferably, but not necessarily, at an end of lamp head 26 that is opposite bendable neck 24, for accommodating one or more light sources 28. According to one preferred embodiment of this invention, as shown in FIG. 9, lamp head 26, directly or indirectly, defines bottom surface 56 of cavity 52 and side wall 58 extending around periphery 60 of bottom surface 56 and away from bottom surface 56. Periphery 60 of bottom surface 56 may be annular, as shown in FIG. 10, or may have any other desired shape. In one embodiment of this invention, bottom surface 56 and side wall 58 are integral. In another embodiment of this invention, bottom surface 56 and side wall 58 are non-integral, connecting elements. As shown in FIG. 11, side wall 58 preferably has proximate edge 62, contacting or connecting to periphery 60 of bottom surface 56, and distal edge 64, opposite proximate edge 62. Distal edge 64 preferably defines periphery 66 of lamp opening 68. In one embodiment of this invention, as shown in FIGS. 1 and 3, lamp 20 may further include lid 70 releasably attachable to distal edge 64 of side wall 58, such as by screws or by other method known to those skilled in the art. Lid 70 can be removed to gain access to light sources 28 spaced apart on bottom surface 56 of cavity 52, for example for replacing non-functioning light sources 28.

Lamp 20 preferably includes one or more light sources 28. According to one embodiment of this invention, at least one of the light sources 28 is a light-emitting diode (LED). Preferably, the at least one light-emitting diode (LED) is selected from the group consisting of a white light-producing LED, a red light-producing LED, a blue light-producing LED, a green light-producing LED, and combinations thereof. In one preferred embodiment of this invention, the plurality of light sources 28 comprise a plurality of light-emitting diodes (LEDs).

In one embodiment of this invention, lamp 20 comprises a plurality of white-light producing LEDs, which, when in operation, provide task lighting, and a plurality of colored light-producing LEDs, which, when in operation, provide color-phasing lighting. The plurality of colored light-producing LEDs preferably comprise at least one red light-producing LED, at least one blue light-producing LED and at lest one green light-producing LED.

Figure 14:
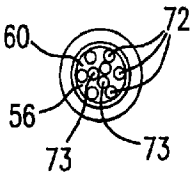
FIG. 14 is a top view of the lamp head shown in FIGS. 12 and 13.
Figure 13:
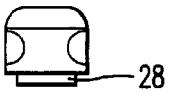
FIG. 13 is a side view of the lamp head shown in FIG. 12, rotated 90 degrees from the view shown in FIG. 12.
Figure 16:
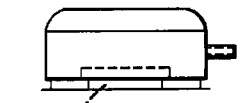
FIG. 16 is a cross sectional view of a lamp base, as shown in FIGS. 8 and 9.
Figure 12:
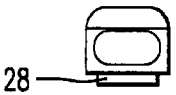
FIG. 12 is a side view of the lamp head, as shown in FIG. 9.
Figure 15:
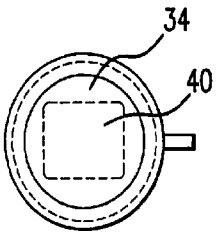
FIG. 15 is a bottom view of the lamp shown in FIGS. 8 and 9.

In one embodiment of this invention, a plurality of white light-producing LEDs 72 are annularly spaced relative to periphery 60 of lamp head 26, such as bottom surface 56, as shown in FIGS. 12-14. A plurality of colored light-producing LEDs 73 are spaced apart relative to the center of bottom surface 56 and/or cavity 52. In one embodiment of this invention, as shown in FIG. 10, lamp 20 further includes diffuser 74 positioned above at least one of colored light-producing LEDs 73. According to one embodiment of this invention, diffuser 74 forms an annular disk defining an aperture proximate to the central axis thereof and is positioned above the colored light-producing LEDs 73 such that colored light-producing LEDs 73 are hidden behind diffuser 74 when observed from a point of observation perpendicular to the plane of the annular disk and aligned with the central axis of the annular disk.

Light sources are preferably activated and/or deactivated by at least one of a plurality of switches 30, as shown in FIG. 4. According to one preferred embodiment, shown in FIG. 4, switches 30 are positioned at a plurality of locations around the surface of lamp head 26. In one preferred embodiment of this invention, lamp 20 comprises a plurality of switches 30 spaced around the perimeter of lamp head 26, as shown in FIG. 4. According to one embodiment of this invention, as shown in FIG. 4, switches 30 are spaced around the perimeter of lamp head 26 in a single plane. Switches 30 are preferably activated and/or deactivated by manual manipulation, such as for example, touching or pressing.

Lamp 20 of this invention is preferably operable by a multi-step activation process. A first actuation of one of the plurality of switches 30 may activate the plurality of white light-producing LEDs 72 to an on-position. A second actuation of one of the plurality of switches 30 may deactivate the white light-producing LEDs 72 to an off-position and may further activate at least one of the plurality of colored light-producing LEDs 73 to an on-position. A third actuation of one of the plurality of switches 30 may deactivate the plurality of colored light-producing LEDs 73 to an off position. The first actuation, the second actuation and the third actuation may be actuations of the same switch or different switches.

In one embodiment of this invention, the first actuation of one of the switches 30 activates a white light mode of operation, which can be used as task lighting, such as, for example, for reading or writing. The second actuation of one of the switches 30 activates a color-phasing mode of operation, which produces an interesting, colorful lighting display. During the color-phasing mode of operation, each or at least one of the colored light-producing LEDs 73 preferably alternates between an on position and an off position to create an interesting lighting effect. Each of the colored light-producing LEDs can produce a single color light or a multi-color light.

Lamp 20 preferably further comprises pliable sheath 32 covering most or all external features of lamp 20, except for lamp opening 68 and support surface 34, as shown in FIGS. 1-3, 5, 6 and 7. In one preferred embodiment of this invention, pliable sheath 32 is a fabric or similar cover and covers substantially the entire lamp with the exception of base support surface 34 and lamp opening 68. Pliable sheath 32 preferably is positioned over the plurality of switches 30, as shown in FIG. 5, and visually conceals the plurality of switches 30. In one embodiment of this invention, pliable sheath 32 is permanently attached to lamp 20. In an alternative embodiment of this invention, pliable sheath 32 is removably positionable on lamp 20. For example, pliable sheath 32 may be interchanged with another cover of different color or made of a different fabric material, for a desired aesthetic and/or design effect. By changing the color or character of pliable sheath 32, one can adapt lamp 20 of this invention to match the changed decorative details of one's surroundings without the need to purchase a new lamp. Pliable sheath 32 may also be removed for washing or cleaning and subsequently reattached to lamp 20. Pliable sheath 32 may be directly or indirectly attached to the surface of lamp 20. In one embodiment of this invention, as shown in FIGS. 4 and 5, padding 50 is connected to surface of lamp 20 and pliable sheath 32 is connected on top of padding 50, for a more cushioned feel.

Pliable sheath 32 may be made of, or incorporate, animal, plant, mineral, synthetic, natural, artificial and/or other fibers, known to those skilled in the art. Pliable sheath 32 may be made of, or incorporate, for example, cotton, velvet, fur, rayon, polyester, spandex, nylon, linen, knitted fabric, woven fabric, nonwoven fabric, rubber, and combinations thereof.

While in the foregoing specification this invention has been described in relation to certain preferred embodiments, and many details are set forth for purpose of illustration, it will be apparent to those skilled in the art that this invention is susceptible to additional embodiments and that certain of the details described in this specification and in the claims can be varied considerably without departing from the basic principles of this invention.

What is claimed is:

1. A lamp comprising:

a base including a support surface, the base narrowing in a direction away from the support surface;

a bendable neck having a first end connected to the base and a second end opposite the first end;

a lamp head connected to the second end of the bendable neck;

at least one light source mountable with respect to the lamp head and operatively connectable to a power source;

a plurality of switches actuatable to activate or deactivate the at least one light source;

a pliable sheath visually concealing the plurality of switches and predominantly covering the base, the bendable neck and the lamp head; and wherein the base supports the bendable neck and the lamp head in an upright position.

2. The lamp of claim 1, wherein the at least one light source is a light-emitting diode (LED).

3. The lamp of claim 2, wherein the at least one light-emitting diode (LED) is selected from the group consisting of a white light-producing LED, a red light-producing LED, a blue light-producing LED and a green light-producing LED.

4. The lamp of claim 1, wherein the power source is an internal battery.

5. The lamp of claim 1, wherein the power source is an external power source.

6. The lamp of claim 1 further comprising a USB port positioned within the base, the USB port connectable to a computer.

7. The lamp of claim 1, wherein the plurality of switches are spaced around the perimeter of the lamp head.

8. A lamp comprising:

a base including a support surface, the base narrowing in a direction away from the support surface;

a bendable neck having a first end connected to the base and a second end opposite the first end;

a lamp head connected to the second end of the bendable neck;

a plurality of light sources mountable with respect to the lamp head and operatively connectable to a power source;

a plurality of switches, positioned in a plurality of locations on a surface of the lamp head, each of which is individually actuatable to activate or deactivate the plurality of light sources;

a pliable sheath visually concealing the plurality of switches and substantially covering the base, the bendable neck and the lamp head; and wherein the base supports the bendable neck and the lamp head in an upright position.

9. The lamp of claim 8, wherein the plurality of light sources comprise a plurality of white light-producing LEDs and a plurality of colored light-producing LEDs, the plurality of colored light-producing LEDs comprising at least one red light-producing LED, at least one blue light-producing LED and at least one green light-producing LED.

10. The lamp of claim 9, wherein a first actuation of one of the plurality of switches activates the plurality of white light-producing LEDs to an on-position, a second actuation of one of the plurality of switches deactivates the white light-producing LEDs to an off-position and activates at least one of the plurality of colored light-producing LEDs to an on-position and a third actuation of one of the plurality of switches deactivates the plurality of colored light-producing LEDs to an off-position.

11. The lamp of claim 10, wherein the first actuation, the second actuation and the third actuation are actuations of same switch.

12. The lamp of claim 10, wherein the first actuation, the second actuation and the third actuation are actuations of different switches.

13. The lamp of claim 10, wherein the first actuation activates a white light mode of operation and the second actuation activates a color-phasing mode of operation.

14. The lamp of claim 13, wherein the color-phasing mode of operating comprises each of the colored LEDs alternating between an on position and an off position to create an interesting lighting effect.

15. The lamp of claim 8, further comprising a USB port for connecting the lamp to an external power source or a control device.

16. A lamp comprising:

a base including a support surface and a cylinder narrowing in a direction away from the support surface, the cylinder defining a chamber for accommodating an internal power source;

a bendable neck having a first end connected to the base and a second end opposite the first end;

a lamp head connected to the second end of the bendable neck, the lamp head expanding in a direction away from the bendable neck and defining a cavity at an end opposite the bendable neck;

a plurality of white light-producing LEDs positioned in the cavity formed by the lamp head and operatively connected to a power source;

a plurality of colored light-producing LEDs positioned in the cavity formed by the lamp head and operatively connected to a power source and comprising at least one red light-producing LED, at least one blue light-producing LED and at lest one green light-producing LED;

a plurality of switches positioned in a plurality of locations on a surface of the lamp head, each switch of the plurality of switches is individually actuatable to activate or deactivate the plurality of LEDs, a first actuation of one of the plurality of switches activates the plurality of white light-producing LEDs to an on-position, a second actuation of one of the plurality of switches deactivates the white light-producing LEDs to an off-position and activates at least one of the plurality of colored light-producing LEDs to an on-position and a third actuation of one of the plurality of switches deactivates the plurality of colored light-producing LEDs to an off-position;

a pliable sheath visually concealing the plurality of switches and covering substantially entire outer surface of the lamp; and wherein the support surface supports the bendable neck and the lamp head in an upright position when the bendable neck is bent offsetting the lamp head from over the base.

17. The lamp of claim 16, wherein the first actuation activates a white light mode of operation and the second actuation activates a color-phasing mode of operation.

18. The lamp of claim 16, wherein the pliable sheath is removably positionable on the outer surface of the lamp.

19. The lamp of claim 16, wherein an operation of the lamp is controlled by a computer.

20. The lamp of claim 16, further comprising a USB port in connection communication with the plurality of white light-producing LEDs and the plurality of colored light-producing LEDs.

21. The lamp of claim 16, wherein the plurality of switches are positioned around the perimeter of the lamp head.

* * * * *